US005155429A

United States Patent [19]

Nakao et al.

[11] Patent Number: 5,155,429

[45] Date of Patent: Oct. 13, 1992

[54] THRESHOLD VOLTAGE GENERATING CIRCUIT

[75] Inventors: Kenji Nakao; Takehiko Umeyama, both of Itami, Japan

[73] Assignee: Mitsubishi Denki Kabushiki Kaisha, Tokyo, Japan

[21] Appl. No.: 644,558

[22] Filed: Jan. 23, 1991

[30] Foreign Application Priority Data

Jan. 29, 1990 [JP] Japan ..... 2-19452

[51] Int. Cl.[5] ..... G05F 3/16

[52] U.S. Cl. ..... 323/315; 323/316; 330/288; 307/296.6

[58] Field of Search ..... 323/315, 316, 273; 330/288; 307/264, 296.6

[56] References Cited

U.S. PATENT DOCUMENTS 4,857,864 8/1989 Tanaka et al. ..... 330/288

4,965,510 10/1990 Kriedt et al. ..... 323/315

FOREIGN PATENT DOCUMENTS 0174506 9/1985 Japan ..... 330/288

*Primary Examiner*—Steven L. Stephan

*Assistant Examiner*—Adolf Berhane

*Attorney, Agent, or Firm*—Oblon, Spivak, McClelland, Maier & Neustadt

[57] ABSTRACT

A semiconductor integrated circuit (1) is provided therein with a current mirror circuit comprising a first transistor (Q4) through which a reference current flows from a current source (15) connected with one electrode of the first transistor (Q1) and a second transistor (Q5) which supplies a current responsive to the ratio of first and second external resistors (20, 21) connected with other electrodes of the first and second transistors (Q4, Q5) on the basis of the reference current. The current from the second transistor (Q5) flows through an internal resistor (16) connected with one electrode of the second transistor (Q5), so that a threshold voltage is generated across the internal resistor (16). The threshold voltage can be arbitrarily set in accordance with the ratio of the first and second external resistors (20, 21). Further, manufacturing dispersion of the integrated circuit can be cancelled when the current from the current source (15) provided in the integrated circuit (1) is converted into a voltage by the internal resistor (16).

6 Claims, 4 Drawing Sheets

THRESHOLD VOLTAGE GENERATING CIRCUIT

BACKGROUND OF THE INVENTION

1. Field of the Invention

The present invention relates to a threshold voltage generating circuit for generating threshold voltages, which are employed for discriminating signals in a semiconductor integrated circuit.

2. Description of the Background Art

FIG. 1 is a circuit diagram showing a conventional threshold voltage generating circuit. Referring to FIG. 1, a differential amplifier formed by npn transistors Q1 and Q2 is provided in a semiconductor integrated circuit 1, which is formed on a semiconductor substrate. The emitters of the transistors Q1 and Q2 are connected to one end of a constant current source 4 through resistors 2 and 3, respectively, while the other end of the constant current source 4 is grounded. The collector of the transistor Q1 is connected to a power source $V_{CC}$, while the collector of the transistor Q2 is connected to the power source $V_{CC}$ through a resistor 5. A voltage obtained by dividing an external reference voltage 6 by external resistors 7 and 8 is applied to the base of the transistor Q1, while an internal reference voltage 9 is applied to the base of the transistor Q2. The external reference voltage 6 may be replaced by a voltage source 10 provided in the semiconductor integrated circuit 1, as shown by dotted lines in FIG. 1.

In operation, a current which is responsive to the base voltage difference between the transistors Q1 and Q2 flows to the resistor 5. A voltage drop $V_a$ is developed in the resistor 5 by this current, and is derived as a threshold voltage. The threshold voltage $V_a$ can be changed by adjusting the voltage dividing ratio between the external resistors 7 and 8.

FIG. 2 is a circuit diagram showing another conventional threshold voltage generating circuit. Referring to FIG. 2, a semiconductor integrated circuit 1 is provided therein with a voltage-to-current conversion circuit, which is formed by an operational amplifier 11, an npn transistor Q3 and a resistor 12. The output of the operational amplifier 11 is oonnected to the base of the transistor Q3. The emitter of the transistor Q3 is connected to a negative input of the operational amplifier 11, while being grounded through the resistor 12. The collector of the transistor Q3 is connected to a voltage source 14 through a resistor 13. A voltage obtained by dividing an external reference voltage 6 by external resistors 7 and 8 is applied to a positive input of the operational amplifier 11.

In operation, a current which is responsive to the voltage applied to the positive input of the operational amplifier 11 flows to the transistor Q3. This current also flows to the resistor 13, so that a voltage drop $V_a$ developed in the resistor 13 is used as a threshold voltage. Similarly to the circuit shown in FIG. a desired threshold voltage $V_a$ can be obtained by adjusting the voltage dividing ratio between the external resistors 7 and 8.

The conventional threshold voltage generating circuits have the aforementioned structures, each adapted to generate a voltage which is responsive to the reference voltage supplied from the exterior of the semiconductor integrated circuit through the amplifier provided in the semiconductor integrated circuit, to use this voltage as a threshold voltage within the semiconductor integrated circuit. Thus, the circuit is complicated in structure, and dispersion of threshold voltages is increased due to manufacturing dispersion of such integrated circuits. Because of a large number of components. The circuit is further complicated when a plurality of threshold voltages are generated.

SUMMARY OF THE INVENTION

A threshold voltage generating circuit in accordance with the present invention comprises a current mirror circuit including a first transistor serving as a reference transistor and a second transistor which are formed in a semiconductor integrated circuit to have a common control electrode, a current source formed in the semiconductor integrated circuit and connected to one electrode of the first transistor, an internal resistor formed in the semiconductor integrated circuit and connected to one electrode of the second transistor for generating a threshold voltage responsive to a current flowing therethrough, and first and second external resistors provided in an exterior of the semiconductor integrated circuit and connected to other electrodes of the first and second transistors, respectively, for setting the threshold voltage by the ratio therebetween.

According to the present invention, a reference current flows to a first transistor from a current source, while a current which is responsive to the ratio of a first external resistor to a second external resistor with respect to the reference current flows to a second transistor. The current flowing to the second transistor also flows to an internal resistor, which in turn generates a threshold voltage in response to this current. The threshold voltage is arbitrarily determined in response to the ratio of the first external resistor to the second external resistor. The number of such threshold voltages can be increased by increasing the number of second transistors in a current mirror circuit. Further, manufacturing dispersion of an integrated circuit is cancelled when a current from the current source provided in the integrated circuit is converted to a voltage by the internal resistor.

Accordingly, an object of the present invention is to provide a threshold voltage generating circuit, which can accurately generate a desired number of threshold voltages at desired values with a simple circuit structure.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
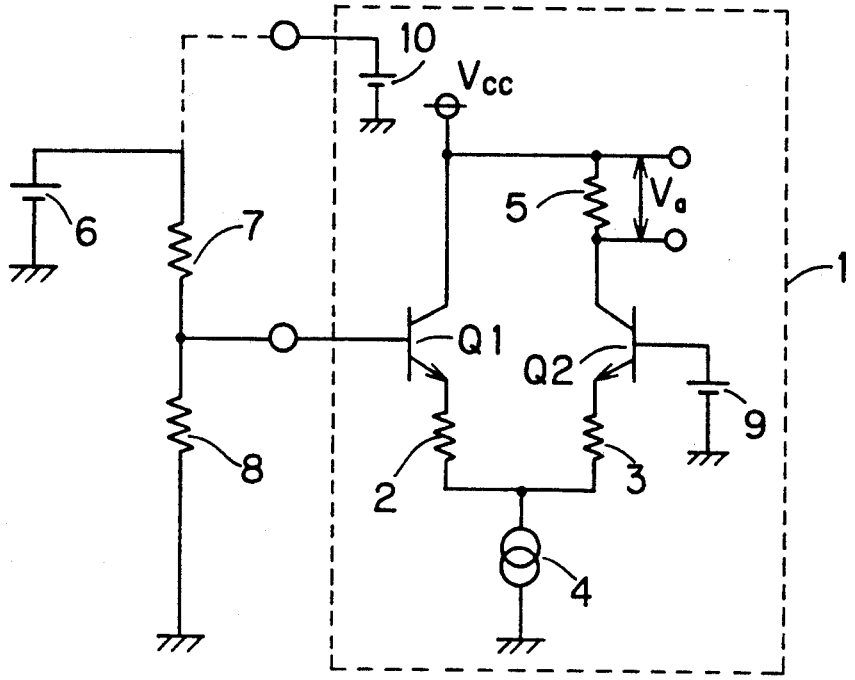
FIG. 1 PRIOR ART
FIGS. 1 and 2 are circuit diagrams showing conventional threshold voltage generating circuits.
Figure 2:
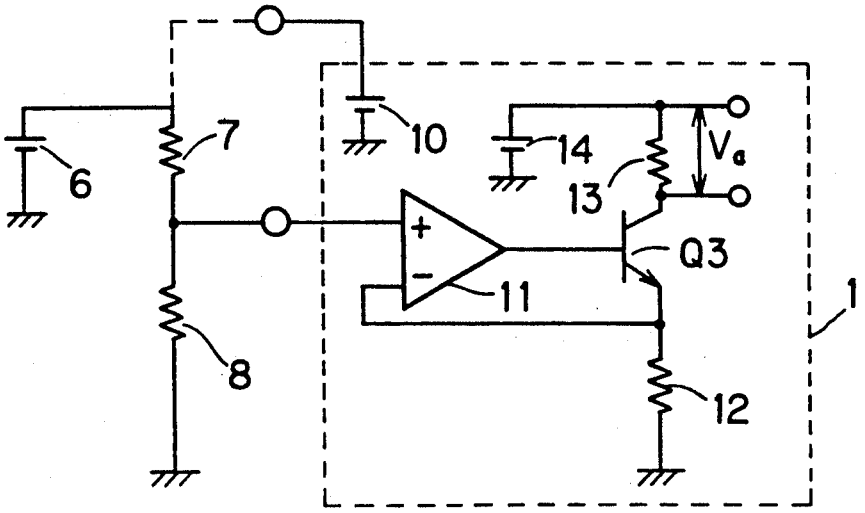
FIG. 2 PRIOR ART
Figure 3:
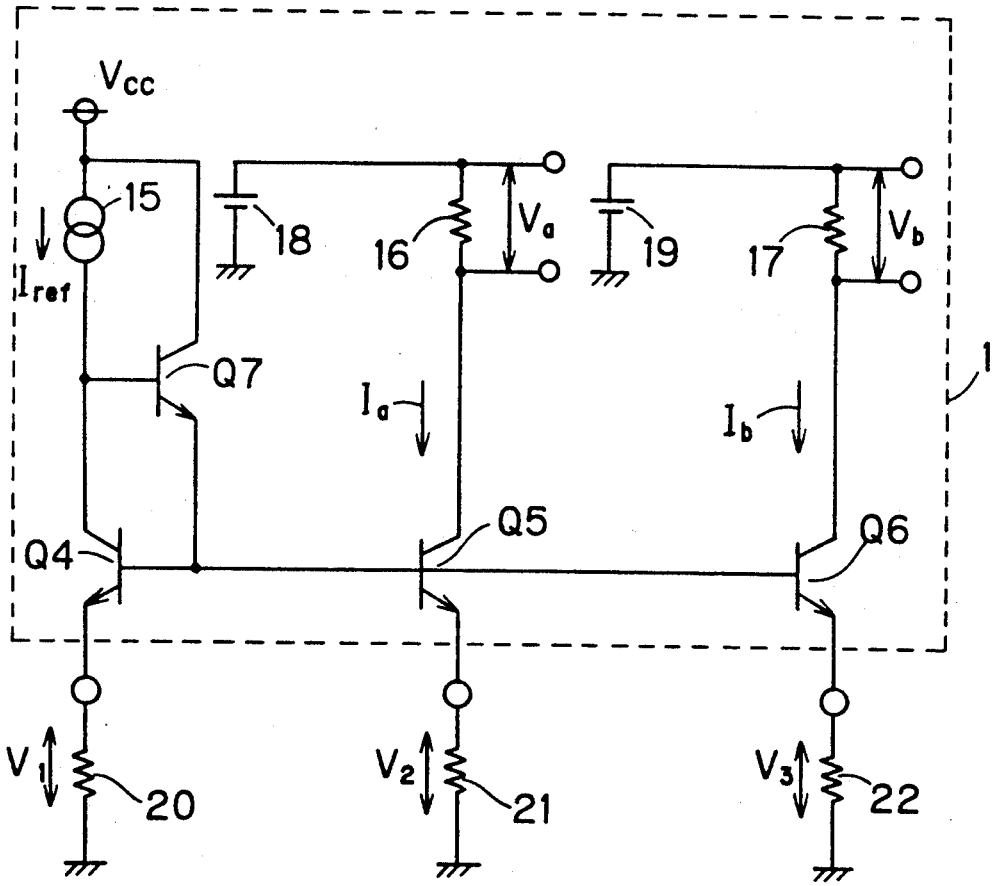
FIG. 3 is a circuit diagram showing an embodiment of a threshold voltage generating circuit according to the present invention.

FIG. 3 is a circuit diagram showing an embodiment of a threshold voltage generating circuit according to the present Invention. Referring to FIG. 3, a semiconductor integrated circuit 1 formed on a semiconductor substrate is provided therein with a current mirror circuit, which is formed by npn transistors Q4, Q5 and Q6. The bases of the transistors Q4, Q5 and Q6 are connected in common. The collector of the transistor Q4, which forms the basis of the current mirror circuit, is connected to a power source $V_{CC}$ through a reference current source 15, as well as to the base of a transistor 07. The emitter of the transistor Q7 is connected to the base of the transistor Q4, and the collector thereof is connected to the power source $V_{CC}$. The collectors of the transistors Q5 and Q6 are connected to arbitrary constant voltage sources 18 and 19 through internal resistors 16 and 17, respectively. The emitters of the transistors Q4, Q5 and Q6 are grounded through external resistors 20, 21 and 22, respectively.

In operation, base currents of the transistors Q4, Q5 and Q6 are supplied from the power source $V_{CC}$ through the transistor Q7. Since the transistor Q7 has a large amplification facter, its base current is substantially negligible. If the base currents of the transistors Q4, Q5 and Q6 are not so large, the transistor Q7 may be omitted to directly connect the base and the collector of the transistor Q4 with each other.

It is assumed here that, when a current $I_{ref}$ is supplied from the reference current source 15 to the transistor Q4, currents $I_a$ and $I_b$ flow to the transistors Q5 and Q6, respectively. It is further assumed that voltages $V_1$, $V_2$ and $V_3$ are developed across the external resistors 20, 21 and 22, respectively. Since the bases of the transistors Q4, Q5 and Q6 are connected in common, the following equation holds:

$$V_1 + V_{BE4} = V_2 + V_{BE5} = V_3 + V_{BE6} \quad \ldots (1)$$

where $V_{BE4}$, $V_{BE5}$ and $V_{BE6}$ represent base-to-emitter voltages of the transistors Q4, Q5 and Q6, respectively. Assuming that $R_{20}$, $R_{21}$ and $R_{22}$ represent resistance values of the external resistors 20, 21 and 22, respectively, $$V_1 = I_{ref} R_{20} \quad \ldots (2)$$

$$V_2 = I_a \cdot R_{21} \quad \ldots (3)$$

$$V_3 = I_b \cdot R_{22} \quad \ldots (4)$$

These equations (2), (3) and (4) are substituted in the equation (1), to attain the following equation (5):

$$\begin{aligned} I_{ref} \cdot R_{20} + V_{BE4} &= I_a \cdot R_{21} + V_{BE5} \\ &= I_b \cdot R_{22} + V_{BE6} \end{aligned} \quad (5)$$

Hence, $$\frac{I_a}{I_{ref}} = \frac{R_{20}}{R_{21}} \left( 1 - \frac{V_{BE5} - V_{BE4}}{R_{20} \cdot I_{ref}} \right) \quad (6)$$

$$\frac{I_b}{I_{ref}} = \frac{R_{20}}{R_{22}} \left( 1 - \frac{V_{BE6} - V_{BE4}}{R_{20} \cdot I_{ref}} \right) \quad (7)$$

$(V_{BE5} - V_{BE4})$ and $(V_{BE6} - V_{BE4})$ are about 0 to 20 mV and $R_{20} \cdot I_{ref}$ is about 0.3 to 1 V, such that:

$$V_{BE5} - V_{BE4} << R_{20} \cdot I_{ref} \quad \ldots (8)$$

$$V_{BE6} - V_{BE4} << R_{20} \cdot I_{ref} \quad \ldots (9)$$

Hence, the equations (6) and (7) can be transformed as follows:

$$\frac{I_a}{I_{ref}} \approx \frac{R_{20}}{R_{21}} \quad (10)$$

$$\frac{I_b}{I_{ref}} \approx \frac{R_{20}}{R_{22}} \quad (11)$$

Thus, the collector currents $I_a$ and $I_b$ of the transistors Q5 and Q6 are expressed as follows:

$$I_a = \frac{R_{20}}{R_{21}} \cdot I_{ref} \quad (12)$$

$$I_b = \frac{R_{20}}{R_{22}} \cdot I_{ref} \quad (13)$$

In general, a current $I_{ref}$ of a current source, such as the reference current source 15, formed in an integrated circuit is expressed as follows:

$$I_{ref} = A/R_0 \quad \ldots (14)$$

where A represents a constant, and $R_0$ represents internal resistance in relation to the reference current source 15. Thus, the equation (14) is substituted in the equations (12) and (13) to attain:

$$I_a = \frac{R_{20}}{R_{21}} \cdot \frac{A}{R_0} \quad (15)$$

$$I_b = \frac{R_{20}}{R_{22}} \cdot \frac{A}{R_0} \quad (16)$$

Hence, assuming that $R_{16}$ and $R_{17}$ represent resistance values of the internal resistors 16 and 17, the threshold voltages $V_a$ and $V_b$ developed across the internal resistors 16 and 17 are expressed as follows:

$$V_a = \frac{R_{20}}{R_{21}} \cdot \frac{R_{16}}{R_0} \cdot A \quad (17)$$

$$V_b = \frac{R_{20}}{R_{22}} \cdot \frac{R_{17}}{R_0} \cdot A \quad (18)$$

Thus, the threshold voltages $V_a$ and $V_b$ are determined by the products of the ratios ($R_{20}/R_{21}$ and $R_{20}/R_{22}$) between the external resistors and the ratios ($R_{16}/R_0$ and $R_{17}R_0$) between the internal resistors. Since the external resistors are discrete components whose resistance values are correct, the ratios therebetween are also correct. Further, dispersion of resistance values caused by manufacturing dispersion of the integrated circuit 1 is cancelled by the ratios between the internal resistors. Therefore, it is possible to sufficiently correctly set the threshold voltages $V_a$ and $V_b$. Further, the threshold voltages $V_a$ and $V_b$ can be set at desired values by changing the ratios ($R_{20}/R_{21}$ and $R_{20}/R_{22}$) between the external resistors.

Figure 4:
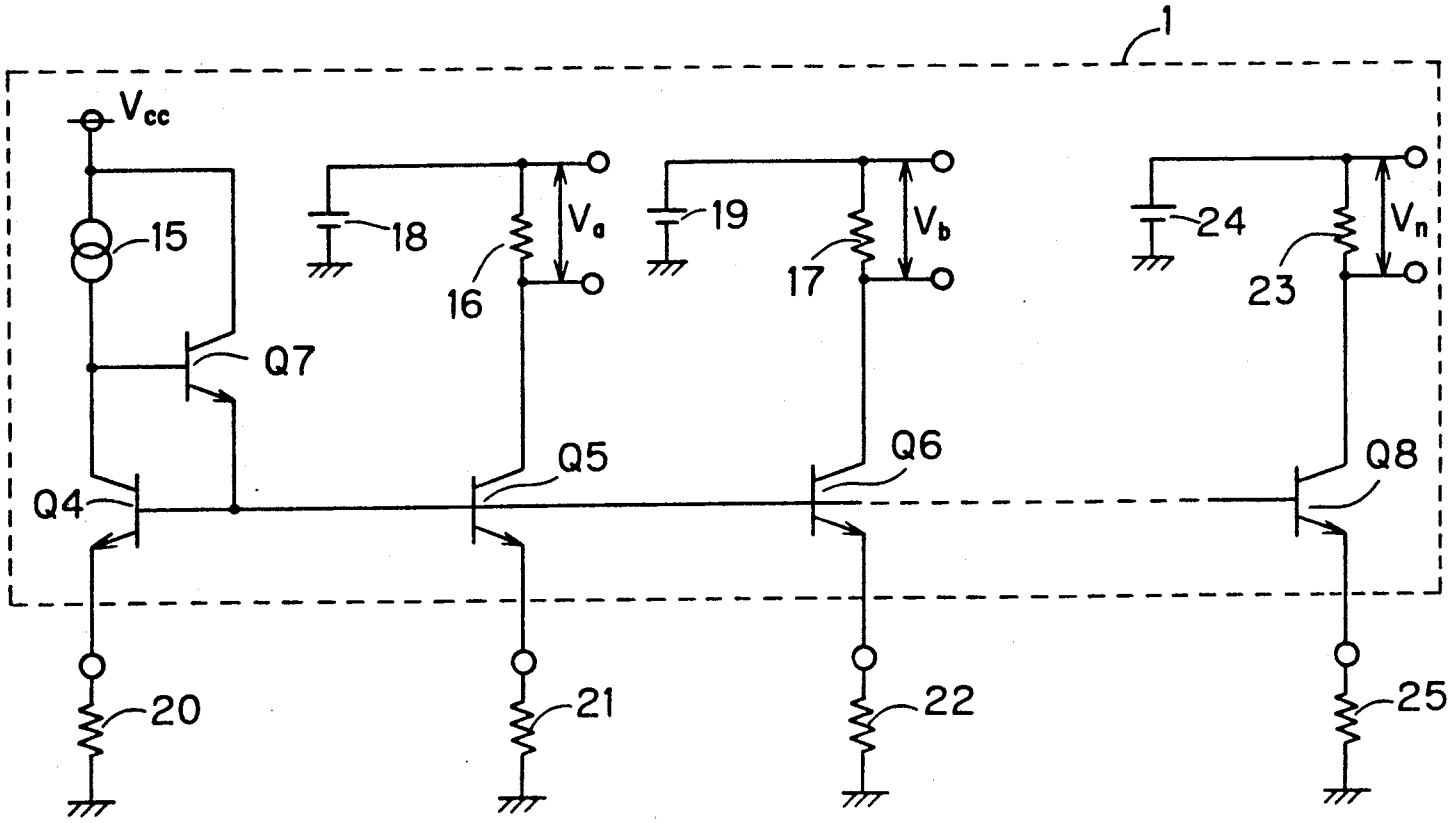
FIG. 4 is a circuit diagram showing another embodiment of a threshold voltage generating circuit according to the present invention.

FIG. 4 is a circuit diagram showing another embodiment of a threshold voltage generating circuit according to the present invention. In this embodiment, the number of transistors forming a current mirror circuit is increased as compared with the embodiment shown in FIG. 3, in order to generate n threshold voltages $V_a$, $V_b, \ldots, V_n$. Referring to FIG. 4, a transistor Q8 typically represents the increased transistors. Similarly to transistors Q5 and Q6, the collector of the transistor Q8 is connected to an arbitrary constant voltage source 24 through an internal resistor 23, and the emitter thereof is grounded through an external resistor 25.

Through operation similar to the above, a threshold voltage $V_n$ expressed as follows is developed across the internal resistor 23:

$$V_n = \frac{R_{20}}{R_{25}} \cdot \frac{R_{23}}{R_0} \cdot A \tag{19}$$

Thus, the number of threshold voltages can be easily increased by increasing the number of transistors forming a current mirror circuit.

Figure 5:
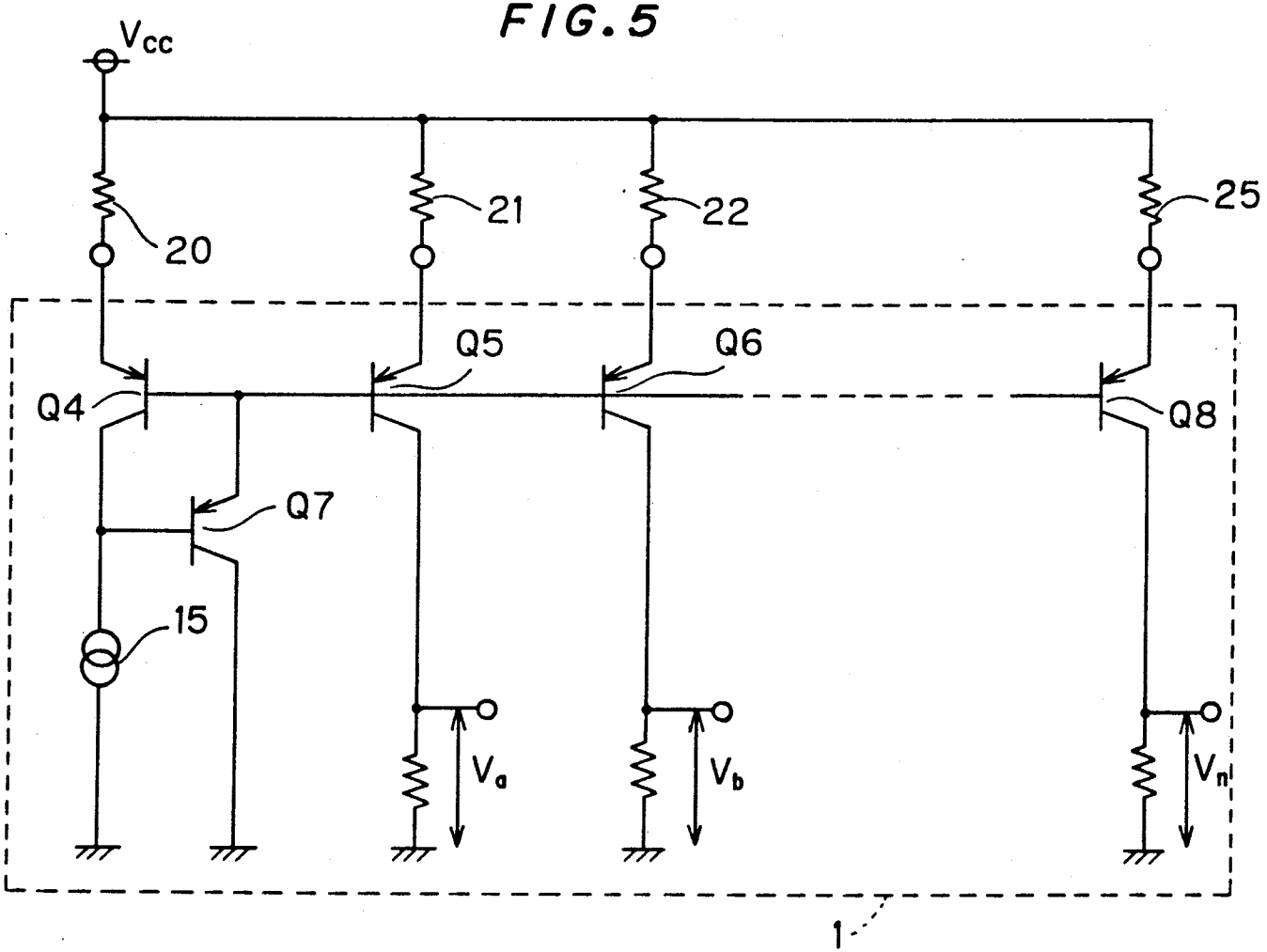
FIG. 5 is a circuit diagram showing still another embodiment of a threshold voltage generating circuit according to the present invention.

FIG. 5 is a circuit diagram showing still another embodiment of a threshold voltage generating circuit according to the present invention. In this embodiment, the transistors Q4 to Q8 shown in FIG. 4 are replaced by pnp transistors, and the level of a power source $V_{CC}$ and the ground level are inverted. In this case, threshold voltages $V_a, V_b, \ldots V_n$ are set from the ground level. The operation of this embodiment is similar to those of the aforementioned embodiments. Thus, it is possible to accurately set threshold voltages in this embodiment similarly to the aforementioned embodiments.

Although the present invention has been described and illustrated in detail, it is clearly understood that the same is by way of illustration and example only and is not to be taken by way of limitation. The spirit and scope of the present invention should be limited only by the terms of the appended claims.

What is claimed is:

1. A threshold voltage generating circuit, comprising:

a current mirror circuit including a first transistor serving as a reference transistor and a second transistor which are formed in a semiconductor integrated circuit to have a common control electrode;

a current source formed in said semiconductor integrated circuit and connected to one electrode of said first transistor;

an internal resistor formed in said semiconductor integrated circuit and connected to one electrode of said second transistor for generating a threshold voltage for use in said semiconductor integrated circuit responsive to a current flowing therethrough; and first and second external resistors provided in an exterior of said semiconductor integrated circuit and connected to other electrodes of said first and second transistors, respectively, for setting said threshold voltage from outside of said semiconductor integrated circuit by the ratio between said first and second external resistors.

2. A threshold voltage generating circuit in accordance with claim 1, wherein said one electrode of said first transistor is connected with a first power source potential through said current source, and said other electrodes of said first and second resistors are connected with a second power source potential through said first and second external resistors, respectively.

3. A threshold voltage generating circuit in accordance with claim 1, further comprising a constant voltage source connected with said one electrode of said second transistor through said internal resistor.

4. A threshold voltage generating circuit in accordance with claim 2, further comprising a third transistor having a control electrode connected with said one electrode of said first transistor, one electrode connected with said first power source potential and the other electrode connected with said common control electrode of said first and second transistors.

5. A threshold voltage generating circuit in accordance with claim 4, wherein said first, second and third transistors are npn transistors, said one electrodes and other electrodes of said first, second and third transistors are collectors and emitters, respectively, and said first and second power source potentials are high and low power source potentials, respectively.

6. A threshold voltage generating circuit in accordance with claim 4, wherein said first, second and third transistors are pnp transistors, said one electrodes and other electrodes of said first, second and third transistors are collectors and emitters, respectively, and said first and second power source potentials are high and low power source potentials, respectively.

* * * * *

UNITED STATES PATENT AND TRADEMARK OFFICE

CERTIFICATE OF CORRECTION

PATENT NO. : 5,155,429

DATED : October 13, 1992

INVENTOR(S) : KENJI NAKAO ET AL

It is certified that error appears in the above-identified patent and that said Letters Patent is hereby corrected as shown below:

In the Abstract, line 5, change "(Q1)" to --(Q4)--.

Signed and Sealed this

Fourth Day of January, 1994

*Attest:*

*Attesting Officer*

Bruce Lehman

BRUCE LEHMAN

*Commissioner of Patents and Trademarks*